US010453309B1

(12) United States Patent
Liss

(10) Patent No.: US 10,453,309 B1
(45) Date of Patent: Oct. 22, 2019

(54) INTERACTIVE SLOT MACHINE ARCHITECTURE WITH A FEEDBACK LOOP

(71) Applicant: Press Play Inc., Dallas, TX (US)

(72) Inventor: Benjamin Liss, Dallas, TX (US)

(73) Assignee: Press Play Inc., Dallas, TX (US)

( * ) Notice: Subject to any disclaimer, the term of this patent is extended or adjusted under 35 U.S.C. 154(b) by 0 days.

(21) Appl. No.: 16/292,235

(22) Filed: Mar. 4, 2019

(51) Int. Cl.
*G07F 17/32* (2006.01)
*G07F 17/34* (2006.01)

(52) U.S. Cl.
CPC ..... *G07F 17/3267* (2013.01); *G07F 17/3255* (2013.01); *G07F 17/3295* (2013.01); *G07F 17/34* (2013.01)

(58) Field of Classification Search
CPC ..... G07F 17/3267; G07F 17/3255; G07F 17/3295; G07F 17/34
See application file for complete search history.

(56) References Cited

U.S. PATENT DOCUMENTS 7,175,524 B2 2/2007 Bansemer
7,410,172 B1 8/2008 Muskin
8,033,912 B2 10/2011 Cannon
8,328,628 B2 * 12/2012 Kim ..... G07F 17/326 463/25
8,337,300 B2 12/2012 Bowers
9,087,437 B2 7/2015 Kroeckel
2003/0119576 A1 6/2003 McClintic
2006/0030400 A1 2/2006 Mathis
2007/0105620 A1 * 5/2007 Cuddy ..... G07F 17/32 463/26
2008/0153570 A1 6/2008 Esses
2009/0075720 A1 3/2009 Mathis
2010/0056259 A1 * 3/2010 Okada ..... G07F 17/32 463/25
2010/0120503 A1 * 5/2010 Hoffman ..... G07F 17/3272 463/20
2011/0009178 A1 1/2011 Gerson
2017/0154494 A1 6/2017 Cire
2017/0228976 A1 8/2017 Chesworth
2017/0330420 A1 11/2017 Merati
2018/0047253 A1 * 2/2018 Vann ..... G07F 17/3262
2018/0082543 A1 3/2018 Schaefer

* cited by examiner

*Primary Examiner* — Corbett B Coburn
(74) *Attorney, Agent, or Firm* — Muskin and Farmer LLC

(57) ABSTRACT

A method, apparatus, and computer readable storage to implement a slot machine game which has a non-skill main game component (spinning reels) and a skill bonus round. The skill bonus round can be triggered randomly based on an individual player's own bonus round trigger probability. Each player's bonus round trigger probability is adjusted in order to offset the player's own skill in comparison to the skill of the other players on the platform.

22 Claims, 6 Drawing Sheets

INTERACTIVE SLOT MACHINE ARCHITECTURE WITH A FEEDBACK LOOP

BACKGROUND OF THE INVENTION

Field of the Invention

The present general inventive concept is directed to a method, apparatus, and computer readable storage medium directed to a game of chance which utilizes a feedback loop.

Description of the Related Art

Gaming is a multibillion-dollar industry. There are games of pure chance (e.g. slots) and games of pure skill (e.g. chess) and a whole spectrum of games that have elements of both chance and skill. Wagering on games of skill is legal in many jurisdictions in the United States, whereas wagering on games of chance is illegal outside of licensed casinos and other like establishments in the United States.

What is needed is an improved way for players to win real money playing games of chance.

SUMMARY OF THE INVENTION

It is an aspect of the present invention to provide an improved slot machine game.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
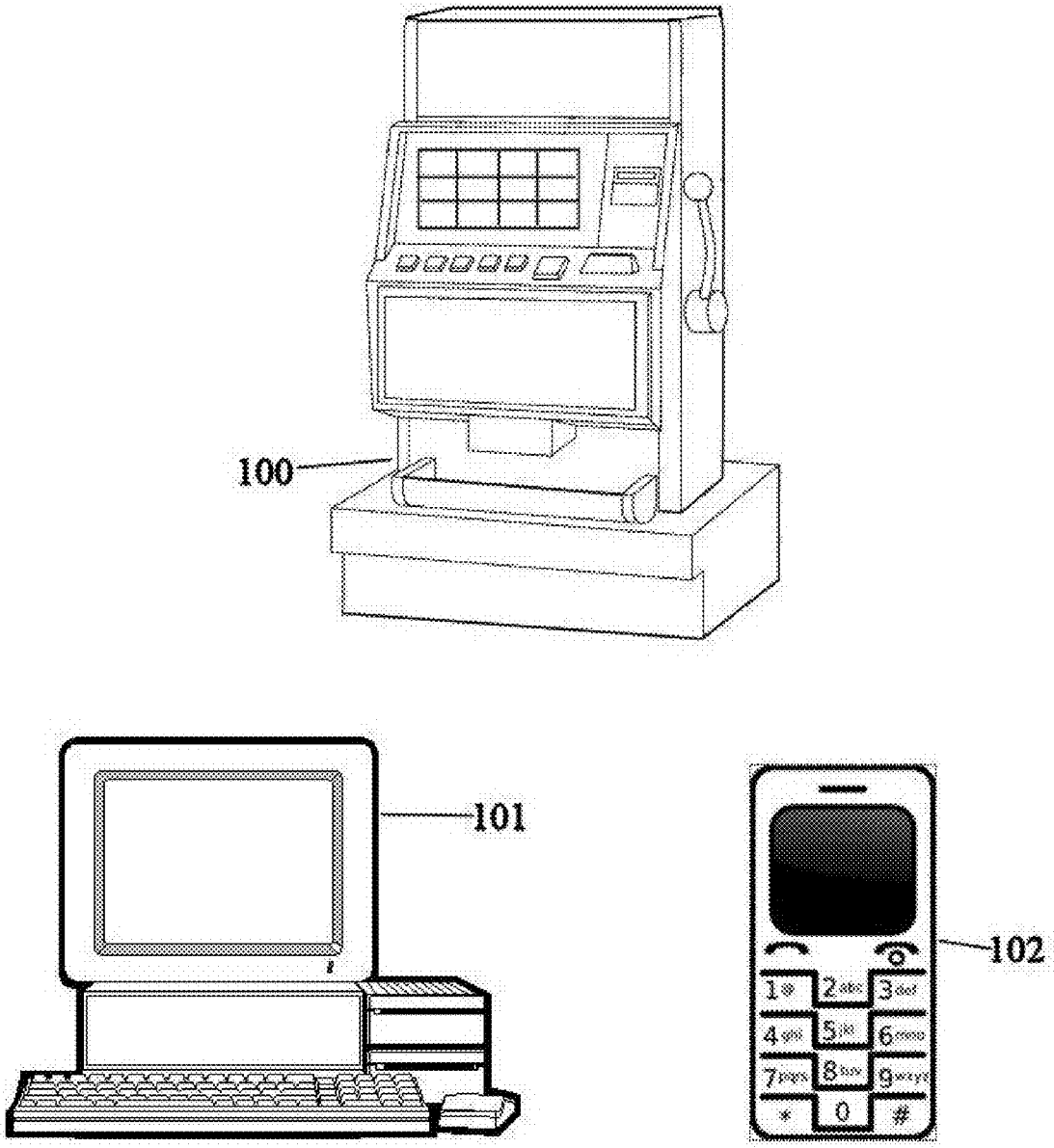
FIG. 1 is a drawing illustrating numerous apparatuses that can play the game of chance (e.g. slot machine game) described herein, according to an embodiment.

Reference will now be made in detail to the presently preferred embodiments of the invention, examples of which are illustrated in the accompanying drawings, wherein like reference numerals refer to like elements throughout.

The present inventive concept relates to a game of chance (e.g. a slot machine game) in which players can legally play said game of chance without depositing real money. Games of skill are legal in some jurisdictions, and certain jurisdictions utilize tests such as the "predominance test" or the "material element test" in order to determine whether a game qualifies as a legal game of skill. The game of chance (e.g. slot machine game) has a skill bonus round which is predominantly skill based (the predominance test) or skill plays a material role in determining the game's outcome (the material element test). The bonus round is triggered by a random probability which is adjusted in real time for each particular player to result in each player having an overall expected award of the game that is the same. The bonus round trigger probability is adjusted based on the player's overall performance on the skill bonus round. The more skillfully the player plays the skill bonus round, the lower the bonus round trigger probability will drop, and the less skillfully the player plays the skill bonus round, the higher the bonus round trigger probability will rise. The results in the skill bonus round (also referred to as skill bonus game, etc.) may result in the player winning real money.

FIG. 1 is a drawing illustrating numerous apparatuses that can play the game of chance (e.g. slot machine game) described herein, according to an embodiment.

The game described herein can be played on an electronic gaming machine 100 that can be found in brick and mortar casinos or other venues such as internet cafes, etc. Cash (or cashless vouchers) can be inserted into the machine 100 using a bill acceptor which credits the machine with a respective amount of credits which can then be used to play the game, and winnings are paid out in the form of credits which can then be cashed out for cash or a cashless voucher (ticket) that can be redeemed for cash. The game described herein can exist on a software module pre-installed on the slot machine 100 or can be downloaded to the electronic gaming machine 100 from a central remote server.

The game described herein can also be played on a computer 101 such as a personal computer, laptop, etc. The game can be downloaded to the computer 101 and stored locally on the computer 101. Alternatively, the computer 101 can have an internet connection (not illustrated) so that the game can be served from a remote location and played and displayed on the computer 100. For example, the game can be played on an online social gaming casino in which the results are determined on a remote server and transmitted to the computer 101 so that the computer displays the results. The game can also be played on the computer 101 for play on a social networking site (e.g., FACEBOOK, etc.) wherein the game software can be launched from within the social network site itself.

The game described herein can also be played on a cell phone 102 or any other type of portable device, such as a tablet computer, etc. The portable device can implement any of the paradigms described above with respect to the computer 101 (e.g., online social gaming casino, social networking site, etc.)

An inventive concept herein relates to a game of chance (e.g. slot machine game) which has a non-skill main game (e.g. a reel spinning game) in which player skill plays no part in the expected award and also a skill bonus round. The non-skill main game can be a reel spinning game which spins reels which have symbols on them which stop at random positions. Based on the positions, different paylines can award awards to the player on winning combinations. During the non-skill main game, certain predetermined combinations will result in the skill bonus round being triggered, the skill bonus round involving skill (a skill of the player would affect the player's expected award). The success of the player in the skill bonus round would affect his/her chances of triggering the skill bonus round in future non-skill main games.

Figure 2:
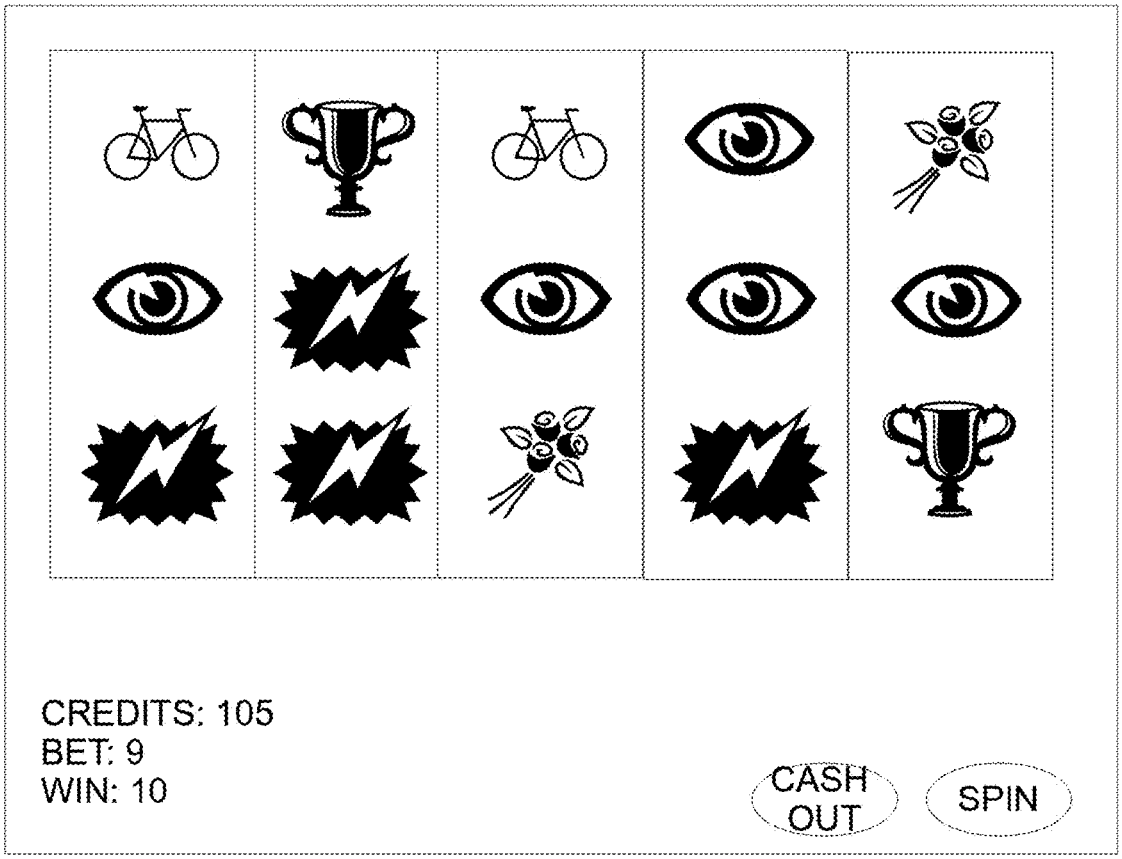
FIG. 2 is a drawing illustrating a game of chance (e.g. slot machine game), according to an embodiment.

FIG. 2 is a drawing illustrating a game of chance (e.g. slot machine game), according to an embodiment. This can be used for the non-skill main game.

Five reels are shown (although any number can be used, for example from 3-6 or more). The reels (after a spin button is pressed) will spin and stop on a random combination. There are various paylines, which are a selection of symbols (typically 5, one from each reel) which will dictate winning combinations. Play of the non-skill main game would either be free (no coins/tokens/credits required to play) or could cost non-monetary credits which have no cash value and cannot be redeemed for cash but can be earned in various ways (such as watching advertisements, etc.) Winning payouts on the non-skill main game could result in in-game currency (e.g. non-monetary credits), entries into contests (e.g. sweepstakes) or entry into the skill bonus round.

All winning combination on active (paid for) paylines will award the player an award using a paytable. Table I below illustrates one example paytable. In an embodiment, the payout amount can be multiplied by the amount bet by the player. For example, if the player bets two non-monetary credits on each payline and one payline gets 5 clovers then the player will win 2,000 non-monetary credits. In another embodiment, the payout amounts are fixed and not based upon the amount bet. There can be no monetary awards won in the non-skill main game. Non-monetary credits cannot be redeemed for cash or exchanged for cash value credits.

TABLE I

| Combination | Payout |
|---|---|
| 5 clovers | 1000:1 |
| 5 eyes | 100:1 |
| 5 lighting | 80:1 |
| 5 trophies | 50:1 |
| 5 plants | 20:1 |
| 5 bicycles | 10:1 |
| 4 clovers | 500:1 |
| 4 eyes | 50:1 |
| 4 lighting | 30:1 |
| 4 trophies | 5:1 |
| 3 clovers | 25:1 |
| 3 eyes | 20:1 |
| All others | lose (-1) |

The reel spinning game involves no skill at all. The player simply presses the "spin" button and the reels will all stop at random positions. There is no way the player can affect where the reels stop.

The aforementioned slots game is just one example of a game of chance that can be utilized for the non-skill main game. Other games of chance can be used for the non-skill main game include but are not limited to Bingo, Roulette, War, etc. In an embodiment, a game of chance that can be used for the non-skill main game can be a game in which skill cannot affect or improve the outcomes at all (e.g. a slot machine game).

Figure 3:
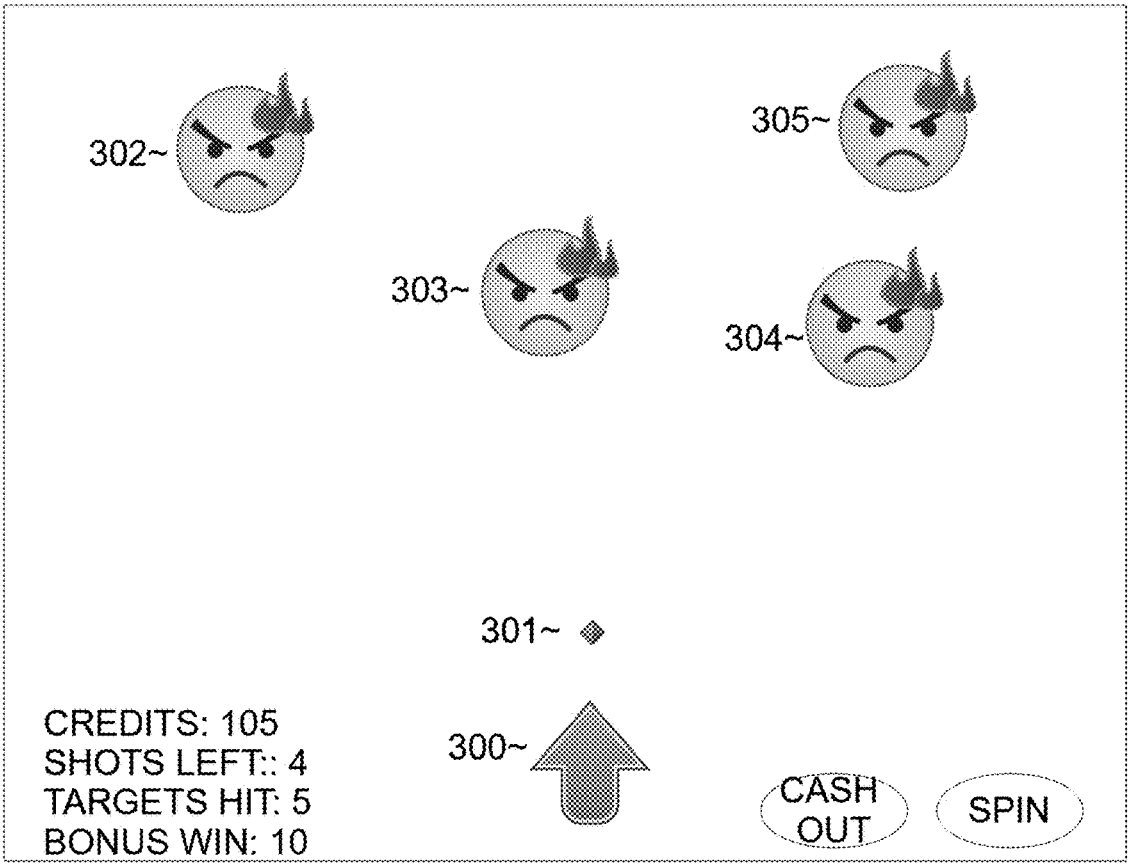
FIG. 3 is a drawing illustrating a skill bonus game, according to an embodiment.

FIG. 3 is a drawing illustrating a skill bonus round, according to an embodiment.

There can be many types of skill bonus rounds. A skill bonus round is a bonus game (round) which is predominantly skill based (the predominance test) or skill plays a material role in determining the game's outcome (the material element test). There can be many types of skill such as dexterity, manual skill, intellectual skill, etc. For example, in this particular example, the player has a predetermined number of shots (e.g. 10) to hit as many targets 302, 303, 304, 305 as possible. The player can move his/her launcher 300 around and fire a shot 301 at any time the player wishes. Once the player shoots all of his/her predetermined shots, then the game ends. The player's prize in the skill bonus round could be based on the number of hits, the time to completion, the accuracy of each hit, etc. Dexterity/manual skill refers to the ability of a player to utilize fast reflexes and accuracy in playing a visual video game, for example by firing at a target accurately, moving an icon to contact or avoid other icons, etc. There exist a large number of video games, and many of them are determined by dexterity/manual skill. Skill can also refer to intellectual skill, such as the player's ability to answer trivia questions, solve puzzles, find hidden objects, etc. While this is just one example, the skill bonus game can be any type of game which is predominantly skill based (the predominance test) or skill plays a material role in determining the game's outcome (the material element test). Of course, a player who has more physical skill (or intellectual skill, etc.) could do better in a skilled game than a player who has less physical skill (or intellectual skill, etc.) The skill bonus round would end after a condition occurs (e.g., a predetermined amount of time expires, a fixed number of shots the player can take were all used up, etc.) and then the game returns back to operation 401 where the player can play the non-skill main game again.

Figure 4:
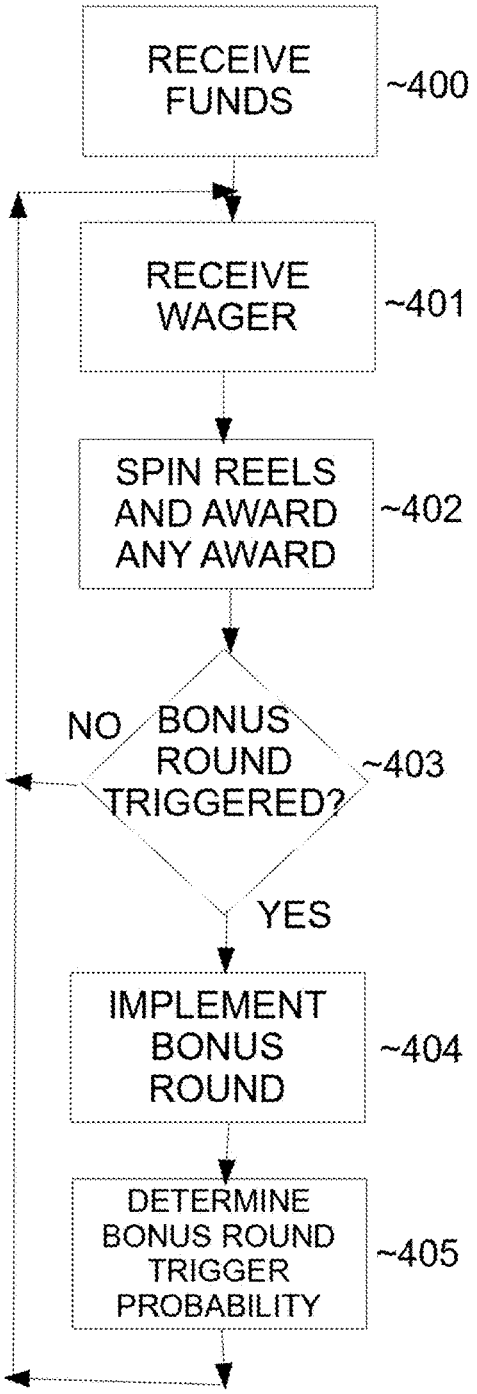
FIG. 4 is a flowchart illustrating a method of implementing a game of chance with a skill bonus round, according to an embodiment.

FIG. 4 is a flowchart illustrating a method of implementing a game of chance with a skill bonus round, according to an embodiment.

The method can begin with operation 400, which receives funds from the player. In the embodiment which is played on a physical slot machine, this can be done as known in the art, for example the player inserts cash (or a cashless ticket) into a bill acceptor (also known as bill validator), pays electronically, uses a payment card, etc. The money deposited then is converted into playable credits.

With regard to the embodiment being played online without having to use real money (cash equivalent) to play, the player will receive funds (non-monetary credits which can be used to initiate the main game) when they open the social gaming casino, social networking site, etc., or in exchange for performing advertising actions (e.g., watching a video, downloading a mobile application, completing a survey, etc.). Players will not deposit real cash in exchange for non-monetary credits. Non-monetary credits have no cash value and are awarded to the player at no monetary cost.

From operation 400, the method proceeds to operation 401, which receives a wager (in non-monetary credits) from the player. Typically, the player indicates how much he/she wishes to wager and then presses a "spin" button (a game initiation). The spin button deducts the wager amount (non-monetary credits) from the player's current amount of non-monetary credits (credit meter) and then initiates the spin of the reels (the non-skill main game). If the player is out of non-monetary funds, the player may perform an advertising action (e.g., watching a video, downloading a mobile application, completing a survey, etc.) to add funds in operation 400. There will not be an unlimited number of advertising actions available to the player, so it is possible the player may have to close the social gaming casino, social networking site, etc. and come back after some duration of time (e.g. one hour to as much as one day).

From operation 401, the method proceeds to operation 402, which initiates the game of chance (the non-skill main game). In this particular non-skill main game (slot machine game), the reels are spun. This is done as known in the art. Each reel is a (physical or virtual) strip comprising a set of symbols (e.g., 32 or any other amount). Each reel will stop on a random stop utilizing a random number generator, and a final position of the reels is where all reels are stopped so that it can be determined whether the player wins an award based on the final position.

In addition, if the final position forms any winning combination on active paylines, those winning combinations are all paid (e.g., the non-monetary credit meter which displays an amount of non-monetary credits the player has increases by the respective amount.) The non-monetary credits can be in game non-monetary coins, sweepstakes tickets, etc. All awards that are won in the non-skill main game are paid out in non-monetary credits.

From operation 402, the method proceeds to operation 403, which determines whether the skill bonus round is triggered. The skill bonus round can be triggered in a number of ways. In this particular non-skill main game (slot machine game), the skill bonus round could be triggered based upon a predetermined combination that appears in the final combination after the reels spin. For example, three or more "bonus" symbols appearing on the final combination could trigger the bonus round. Another way the skill bonus round could be triggered is a random determination (not based upon the final combination). For example, if a given probability occurs (e.g., 1/40, 1/60, etc.) then the skill bonus round would also be triggered (a bonus round trigger probability). In yet another way, a bonus round symbol could be programmed to appear on the reels to trigger the skill bonus round based on the bonus round trigger probability (in other words, based on the bonus round trigger probability if it is determined to trigger the skill bonus round then the bonus round symbols would appear on the reels which would trigger the skill bonus round, and if it is not determined to trigger the skill bonus round then the bonus round symbols would not appear on the reels). The player would typically not know what his/her bonus round trigger probability is or that it is constantly changing based on both the player's own performance (as described herein) and the average performance of others on the platform (as described herein). If in operation 403, the skill bonus round is not triggered, then the method returns to operation 401 which receives another wager.

In another embodiment, the bonus round trigger probability can be implemented in a "mini-game" such as a wheel. For example, after each spin, a wheel can spin (or any other visual indicator) which would be programmed such that the wheel would land on a "bonus round" (which would trigger the skill bonus round) slice (versus an empty slice which would not trigger the skill bonus round) with a probability of the computed bonus round trigger probability.

If in operation 403, the skill bonus round is triggered (in any manner), then the method proceeds to operation 404, which implements the skill bonus round. This is a skill bonus round such as that illustrated and described with respect to FIG. 3. The skill bonus round can be any type of game which is predominantly skill based (the predominance test) or skill plays a material role in determining the game's outcome (the material element test). A more skillful player would typically fare better (earn more real money prizes) compared to a player who is less skillful. The skill bonus round would be completed and a real money prize (if any), such a cash value credits (credits which are redeemable for cash, etc.) is awarded to the player based on how the player performed in the skill bonus round.

From operation 404, the method proceeds to operation 405, which determines a bonus round trigger probability. The player's performance in the skill bonus round (e.g., all of a player's previous performances on a particular skill bonus round (there can be multiple different skill bonus rounds) can be averaged) will affect the probability that the skill bonus round would be triggered on subsequent plays of the game of chance by the same player in operation 403. The game machine/platform would ascertain whether the same player is playing by an identification mechanism, such as the player using a player's card, the player logging in to the game, the game tracking the player's IP address, etc. Performance in the skill bonus round by a particular player will directly affect bonus round trigger probabilities (in operation 403) for plays of the game by that same player (because the player's average award in the skill bonus round is evaluated against the overall average award in the same skill bonus round for all players on the platform). Note however, performance in the skill bonus round by a particular player can indirectly affect bonus trigger probabilities for other players because each player's average award in the skill bonus round will be evaluated against the overall average award awarded in the skill bonus round for all players.

Thus, the interaction between the player's skill in the bonus round and how it affects the bonus trigger probability after the slot game is played is a "feedback loop." The player's performance in the skill bonus round is continuously self-adjusting the bonus trigger probability which is used to determine when the skill bonus round is triggered (initiated).

Since no real money will be won in the non-skill main game (game of chance with no skill being utilized, in other words player skill has no effect on the player's expected award), the overall game will have an overall average award (in cash value credits), which is what the player would win in the skill bonus round. Note that the average award of an individual bonus game will vary based upon the skill of the player, which in turn will influence the probability that the player triggers the bonus game (the "feedback loop"). Thus, a player who is more skilled will have the probability that the bonus round is triggered (in operation 403) reduced, while the player who is less skilled will have the probability that the bonus round is triggered (in operation 403) increased.

For example, an overall average expected award of the overall game can be 0.9. In other words, for each play of the non-skill main game, the player's average award will be 0.9 cash value credits. The game could be designed to adjust the probability of triggering the skill bonus round in order to keep players all winning an average award of 0.9 cash value credits. For example, the bonus round could be triggered by 5% of the spins. That means the average cash value credit award won when playing the non-skill main game would be 18 cash value credits awarded on the skill bonus round ($0.05*x=0.9$, hence $x=18$).

The cash value of a cash value credit could be any number from \$0.01 to \$100 to much greater. Each of these three variables (overall expected award, bonus round trigger percentage (or probability) and amount of cash value credits won in the skill bonus round) can be modified for a predetermined period of time. In other words, on a given day the average award in cash value credits won could increase, while holding the overall expected award constant, thus causing the bonus round trigger percentage to decrease.

Now consider a player who is more skilled and who earns on average 23 cash value credits each time he/she enters the skill bonus round. At a bonus round trigger probability of 5%, this means that this player would earn 0.05*23=1.15 average cash value credits for each play of the non-skill main game (the cash value credits would be earned in the skill bonus round if it is triggered). This could be considered too high, and the game would desire to reduce the probability that the bonus round is triggered for this particular player. To put the average award (in cash value credits) of the bonus game back at 0.9 (like the average player), the probability that the bonus round will be triggered will be 0.9/23=0.03913. In this manner, by reducing the bonus round trigger probability for this particular skilled player, the overall average award can be adjusted to match what the average player is earning.

Thus, the game can be configured so that each player can have a deterministic (predetermined in the long run) cash value award. For example, the award can be a particular overall award, e.g. 0.90 cash value credits per play of the non-skill main game.

The deterministic award can also be a dynamic overall award, for example the average skill bonus round award of all players on the system which can change over time.

Along the same lines, a player who plays the skill bonus round less skillfully than the average player on the platform would have the bonus round trigger frequency (probability) increased (using the same math above) in order to improve this player's overall average award playing the game.

Note that average bonus award can be measured by taking the average of all player's awards for the bonus round (either for all time or over a predetermined past period of time such as one month, one year, etc.) Each individual player's own bonus round average score can be averaged for all of time or over a predetermined past period of time such as one month, one year, etc.

In another embodiment, the bonus round trigger probability would be kept constant for all players, but players would only earn cash value credit, when they performed standard deviations above their personal mean. In other words, after some time a player's performance in a particular skilled bonus game would be known to the system and if that player performed for example 2 standard deviations above his/her average score, then the player would earn a certain number of cash value credits. In this way, each player is competing against himself/herself. Obviously, protections would need to be put in place to prevent players from gaming the system.

Note that various different games of chance (with different game play, payouts, etc.) can be offered with various different types of skill bonus rounds. Each type of skill bonus round would have its own average award. So, for each different skill bonus round (e.g., shooting, racing, trivia, etc.), the system would store each player's own individual scores (bonus award) so each particular player's awards can be averaged to compute the player's own bonus round trigger probability using their average award for each respective bonus round. For each different skill bonus round, the system/platform would also store everyone's (all players) bonus awards so the overall average award for all players could be averaged for that particular skill bonus round.

Note that over time, for each skill bonus round, the overall average award might increase over time as the players get more practice and improve their performance in the skill bonus round. If a player does not improve his/her skill for the skill bonus round (and plays at the same skill level), then this player's bonus trigger probability would increase so that the player's overall average award would match the average player on the platform. Similarly, for a skill bonus round, if the overall average award decreases over time (not likely), then a player who still plays over time at the same skill level will have his/her bonus trigger probability increased so that the player's overall average award would match the average player on the platform.

Note that described above is a system where the average of all players' (on the platform) awards (of cash value credits) in a skill bonus round is computed, and each individual player has his/her own respective bonus round trigger probability adjusted (based on the individual player's average award in the same bonus skill round) so that the individual player's overall average award (of cash value credits) for the overall game (plays of the non-skill main game which may also trigger the skill bonus round) matches what the average player on the platform is being awarded in cash value credits for their overall game. In another embodiment, instead of adjusting the bonus trigger probability so that a particular player's average award (in cash value credits) when playing the overall game would match the average award (of cash value credits) for all players on the platform who play the overall game, the bonus trigger probability is adjusted so that each player's (all players on the platform) average award in cash value credits when playing the overall game is a predetermined amount chosen by the game designers (e.g., 0.95 cash value credits per single play of the non-skill main game). In this embodiment, the skill exhibited by players in the skill bonus round would not affect other player's expected values (and would not affect other player's bonus trigger probabilities).

Note that the methods described herein can be applied to physical or online slot machine games. In an embodiment, the methods described herein can also be applied to an online casual (free play game found on a social networking site) or social gaming casino. That is, players can register with a web site hosting the game (by a gamer server), and the players can then play the game without depositing real money.

Note that the physical slot machine version could use real money (credits redeemable for cash) for both initial wagers (made to play the non-skill main game) and for all awards won (both in the non-skill main game and the skill bonus round). The online casual or social games would not use real money (or credits redeemable for real money/cash) to play the games (e.g. spin the reels) but would use non-cash credits to play the games even though the skill bonus round (which is triggered randomly but would not cost the player additional credits) would award real cash awards (e.g. cash value credits).

While a player is playing, the players would perform advertising actions (e.g., view advertisements on or within the game, watch videos, install mobile apps, complete surveys, etc.) Performing advertising action could also earn a player some additional non-monetary credits (used to play the non-skilled main game). Advertisers would pay (in real money, using an electronic funds transfer, credit card payments, etc.) the platform itself (or its operators) cash money to advertise on the platform (web site), to have surveys filled out by players, for apps that are downloaded by players, etc. The advertising money constitutes the prize pool (with a commission taken out (e.g. 20%) for the game/platform operators), and the prize pool is what is used to award the awards (paid in cash value credits which can be redeemable for money/cash) that the players would win in the skill bonus round.

One benefit of the current methods described herein as applied to a social gaming casino or social networking site is that players can enjoy playing games of chance with the potential to win real cash awards by playing games of skill.

The game would be configured as described herein to equalize the overall average awards of all of the players (by adjusting the probability of triggering the bonus round), as such, no skilled player could (in the long term) take advantage of the game platform by playing skillfully and winning more than other players.

Described above is a method in which the non-skill main game is purely random and player skill cannot affect or improve (or worsen) the player's expected award. In an alternative embodiment, the non-skill main game can actually incorporate an element of skill which can affect the player's expected award so long as the non-skill main game does not have a significant skill aspect (for example it does not satisfy legal tests for being a legal game of skill such as the material element test or the predominance test). So, in other words, in this embodiment, the non-skill main game can actually be a game in which player skill can improve (or reduce) the player's expected award. For example, the non-skill main game can be a game like blackjack, etc. However, everything else described herein remains the same (e.g., the player still uses non-monetary credits to play the non-skill main game). Typically, the non-skill main game would be a different game than the skill bonus round.

Figure 5:
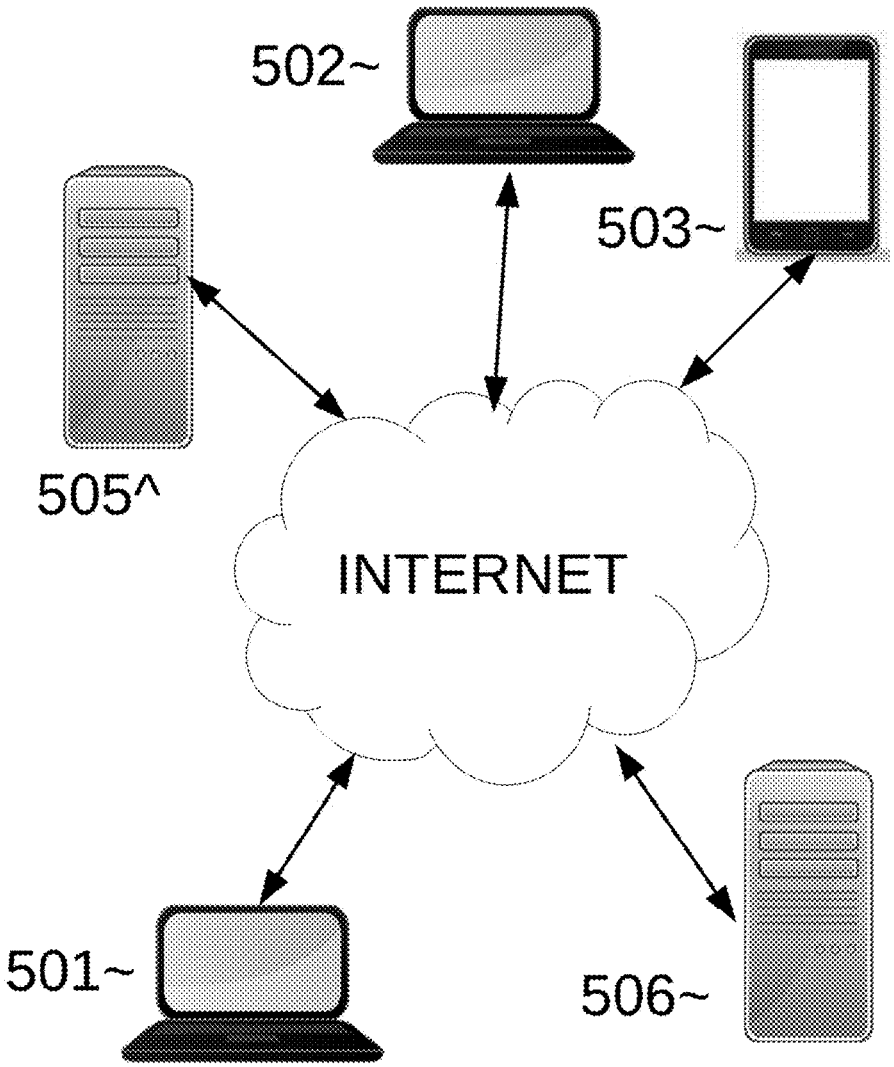
FIG. 5 is a network diagram illustrating participants of the system, according to an embodiment.

FIG. 5 is a network diagram illustrating participants of the system, according to an embodiment.

Any number of players (e.g., 1 to 10,000 or more) can be playing the game described herein remotely and simultaneously such as remote players 501, 502, 503. Remote players can play on any type of computing device, such as a cell phone, laptop, PC, tablet, etc. A game server 505 can implement the game (and all methods described herein) which would enable the remote players to play the game on their computing devices (but typically all game results are determined on the game server 505 so that no players can hack into the system and cheat). One or more advertising servers 506 can be used to serve advertisements to the game server 505 so that those advertisements would be displayed on the players' computing devices while they are playing the game. The advertising servers 506 (or more particularly the company who sponsors each such advertising server 506), would pay to have their advertisements displayed within or on the game. For example, each time an advertisement is displayed it could cost the sponsor one cent. The fees to pay for the advertising can be wired from the advertising server 506 (or another server/account located elsewhere on behalf of the company sponsoring the advertisements) to the game server 505 (or another server/account located elsewhere on behalf of the company sponsoring the game). When players win real cash awards, the winnings are stored in their accounts. Players can cash out their awards at any time by requesting an electronic transfer of funds from an account associated with the game server to the player's personal account (e.g., bank account, etc.)

Figure 6:
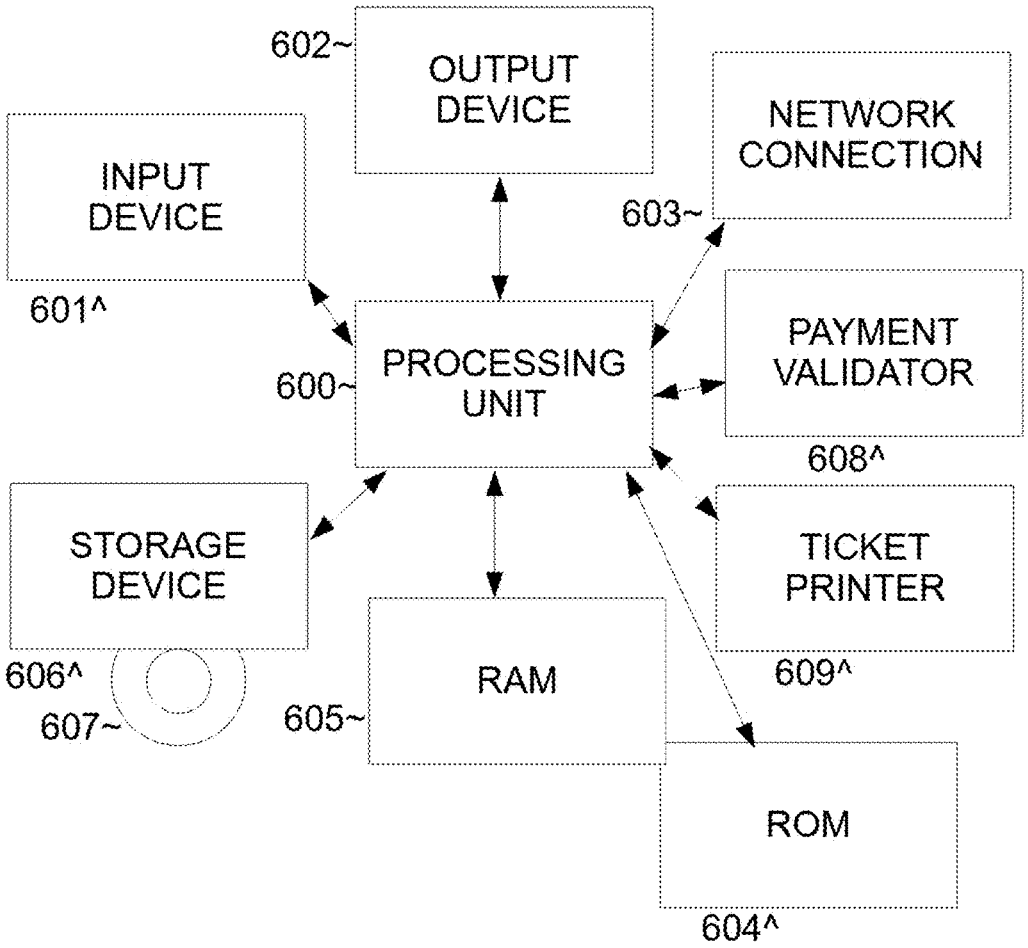
FIG. 6 is a block diagram illustrating exemplary hardware that can be used to implement the game described herein, according to an embodiment.

FIG. 6 is a block diagram illustrating exemplary hardware that can be used to implement the game and methods described herein, according to an embodiment. The hardware in FIG. 6 can be used to implement a computer implementing the game described herein and/or a server that is serving the game to remote computers which are displaying/playing the game to respective players.

A processing unit 600 can be a microprocessor and associated structure (e.g., bus, cache, clock, etc.) which can be connected to an input device (e.g., touch-screen, keyboard, mouse, buttons, etc.) and an output device (e.g., touch-screen, CRT, monitor, etc.) The processing unit 600 can also be connected to a network connection 603 which can connect to a computer communications network such as the Internet, Wi-Fi, LAN, WAN, etc. The processing unit 600 can also be connected to a ROM 604 and a RAM 605 as used in the art. The processing unit 600 can also be connected to a storage device 606 which can be nonvolatile storage device (e.g., BLU-RAY drive, CD-ROM drive, hard drive, EPROM, etc.) A computer readable medium 607 (e.g., BLU-RAY disc, CD-ROM, hard disc, etc.) can be read by the storage device 606 and can store programs and assets that can cause the processing unit 600 to perform any of the methods described herein. The ROM 604 and RAM 605 can also be loaded with instructions that can cause the processing unit 600 to perform any of the methods described herein.

In the embodiment played on a physical gaming machine, the processing unit 600 can also be connected to a payment validator 608 (in the case where the game is being played on a physical electronic gaming machine). The payment validator can be a bill acceptor which accepts currency, identifies it as being valid (typically by using an optical scanner), and then credits the inserted bill amount to the machine (for example inserting a $10 bill will credit the machine with $10 in credits). The bill acceptor can also accept cashless tickets as part of a 'ticket-in-ticket-out" system, in which tickets (cashless vouchers) have cash value and can be inserted into the payment validator 608. The validator 608 validates the ticket (typically be optically scanning a bar-code) and crediting the machine with the respective amount of credits. The payment validator 608 can also include a card reader which can read cards (e.g., with a magnetic stripe or other electronic encoding) so that an account number can be accessed. The cards can be a credit card, player loyalty card, specific casino payment card, or any card that can provide electronic access to a monetary amount owned by the player (owner of the card) which the player can utilize for playing the slot machine. If such a card is used, then the player can optionally enter (using a keypad) an amount the player wishes to withdraw from the account associated with the card to credit to the slot machine.

In the embodiment played on a physical gaming machine, the processing unit 600 can also be connected to a ticket printer 609 (in the embodiment where the game is being played on a physical electronic gaming machine) which can print tickets (cashless vouchers). When the player cashes out on the slot machine (indicated to the machine that the player wishes to cash out and terminate by, typically by pressing a button), a ticket is printed by the ticket printer 609 which carries the amount of credits left on the machine. This ticket can then be used to play other machines in the casino by inserting them into that machine's payment validator. The ticket can also be used to redeem for cash by inserting it into a ticket redemption machine (kiosk) which receives a ticket, validates it (typically by scanning the barcode), and then dispenses an identical amount of cash to what the ticket's value is.

All components herein can be distributed across different such components as needed. For example, a single server as mentioned herein can be distributed across numerous different servers and locations. A processor (or processing unit) can also be distributed across multiple processors in a same or different computer (at a same or different location). The electronic components described herein represent an abstraction but it can be appreciated that the computer systems implementing the methods herein can be more numerous and interconnected than illustrated herein.

If a player is playing the game described herein on a social gaming casino, social networking site or other type of hosted environment, then the player's computer would cooperate with the respective server in order to present the game to the player. The player's computer would perform the instructions necessary to display the game while the remote server can determine the results (e.g. the final arrangement) and communicate this result via the Internet to the player's computer so that the player's computer can accurately display the result. The remote server may track and account for all credits wagered and all real cash prizes won, while the player's computer can display the amount of real cash prizes won at the direction of the remote server so the player cannot tamper with these amounts. The player's computer can also display their current amount of non-monetary credits (which cannot be cashed out for cash) and their current amount of cash value credits they have won that they can redeem (cash out, withdraw, etc.) All games described herein are considered to be played on the site described herein.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer. All features described herein (including all documents incorporated by reference) can be combined with one another without limitation.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method, comprising:

at least one processor executing computer readable instructions which causes the following operations:

receiving a game initiation from a player;

implementing a non-skill main game which involves no skill from the player; paying the player any earned award based on a result of the non-skill main game in non-monetary credits;

determining whether to trigger a skill bonus round based on a bonus round trigger probability for the player;

wherein the determining determines to trigger the skill bonus round;

implementing the skill bonus round which awards a bonus award to the player based on the player's skill;

awarding the bonus award in cash value credits based on the player's performance in the skill bonus round;

computing an average bonus award for the player using prior skill bonus rounds the player has played, wherein the player's performances on prior skill bonus rounds are identified by the player being logged in; and updating the bonus round trigger probability for the player using the player's average bonus award, wherein different players would have different respective bonus round trigger probabilities.

2. The method as recited in claim 1, wherein the updating the bonus round trigger probability also uses an average bonus award from other players playing the skill bonus round.

3. The method as recited in claim 1, wherein the game initiation has no monetary cost to the player.

4. The method as recited in claim 1, wherein the game initiation costs the player non-monetary credits which have no cash value.

5. The method as recited in claim 1, wherein the bonus award is paid in cash value credits which are redeemable for cash.

6. The method as recited in claim 1, wherein an award pool is maintained from advertising revenue paid in money by advertisers, and awards in cash value credits that are paid to the player are paid from the award pool.

7. The method as recited in claim 1, wherein the main game is a slot machine game which spins reels to a final position.

8. The method as recited in claim 1, wherein the skill bonus round involves dexterity on the part of the player.

9. The method as recited in claim 1, wherein the skill bonus round involves intellectual skill on the part of the player.

10. The method as recited in claim 1, wherein the any earned award based on a result of the non- skill main game is paid in non-monetary credits.

11. The method as recited in claim 1, wherein when a user performs an advertising action, the user receives non-monetary credits.

12. An apparatus, comprising: at least one processor connected to the internet, the at least one processor connected to at least one computer readable storage storing computer readable instructions, the computer readable instructions programmed to cause the at least one processor to perform:

receive a game initiation from a player; implement a non-skill main game which involves no skill from the player;

pay the player any earned award based on a result of the non-skill main game in nom monetary credits;

determine whether to trigger a skill bonus round based on a bonus round trigger probability for the player, wherein when the skill bonus round is triggered, award a bonus award in cash value credits to the player based on the player's performance in the skill bonus round, compute an average bonus award for the player using prior skill bonus rounds the player has played wherein the player's performances on prior skill bonus rounds are identified by the player being logged in; and update the bonus round trigger probability for the player using the player's average bonus award, wherein different players would have different respective bonus round trigger probabilities.

13. The apparatus as recited in claim 12, wherein the computer readable instructions are further programmed such that the update the bonus round trigger probability also uses an average bonus award from other players playing the skill bonus round.

14. The apparatus as recited in claim 12, wherein the computer readable instructions are further programmed such that the game initiation has no monetary cost to the player.

15. The apparatus as recited in claim 12, wherein the computer readable instructions are further programmed such that the game initiation costs the player non-monetary credits which have no cash value.

16. The apparatus as recited in claim 12, wherein the computer readable instructions are further programmed such that the bonus award is paid in cash value credits which are redeemable for cash.

17. The apparatus as recited in claim 12, wherein the computer readable instructions are further programmed such that an award pool is maintained from advertising revenue paid in money from advertisers, and awards in cash value credits that are paid to the player are paid from the award pool.

18. The apparatus as recited in claim 12, wherein the computer readable instructions are further programmed such that the main game is a slot machine game which spins reels to a final position.

19. The apparatus as recited in claim 12, wherein the computer readable instructions are further programmed such that the skill bonus round involves dexterity on the part of the player.

20. The apparatus as recited in claim 12, wherein the computer readable instructions are further programmed such that the skill bonus round involves intellectual skill on the part of the player.

21. The apparatus as recited in claim 12, wherein the computer readable instructions are further programmed such that the any earned award based on a result of the non-skill main game is paid in non-monetary credits.

22. The apparatus as recited in claim 12, wherein the computer readable instructions are further programmed such that when a user performs an advertising action, the user receives non-monetary credits.

* * * * *